US010596428B1

(12) United States Patent
Rumble

(10) Patent No.: US 10,596,428 B1
(45) Date of Patent: Mar. 24, 2020

(54) GOLF CLUB

(71) Applicant: Clive Roy Rumble, Hampshire (GB)

(72) Inventor: Clive Roy Rumble, Hampshire (GB)

( * ) Notice: Subject to any disclaimer, the term of this patent is extended or adjusted under 35 U.S.C. 154(b) by 0 days.

(21) Appl. No.: 16/540,113

(22) Filed: Aug. 14, 2019

(51) Int. Cl.
*A63B 53/06* (2015.01)
*A63B 53/08* (2015.01)
*A63B 53/04* (2015.01)

(52) U.S. Cl.
CPC ..... *A63B 53/08* (2013.01); *A63B 53/06* (2013.01); *A63B 53/0466* (2013.01); *A63B 53/065* (2013.01)

(58) Field of Classification Search
USPC ..... 473/324–350
See application file for complete search history.

(56) References Cited

U.S. PATENT DOCUMENTS 645,942 A * 3/1900 Cran ..... A61B 53/047 473/336
2,460,445 A * 2/1949 Bigler ..... A63B 53/08 473/242
3,305,235 A * 2/1967 Williams, Jr. ..... A63B 53/06 473/247
3,606,327 A * 9/1971 Gorman ..... A63B 53/04 473/297
3,610,630 A * 10/1971 Glover ..... A63B 53/0466 473/338
3,652,094 A * 3/1972 Glover ..... A63B 53/08 473/337
3,979,122 A * 9/1976 Belmont ..... A63B 53/047 473/336
3,979,123 A * 9/1976 Belmont ..... A63B 53/04 473/337
4,052,075 A * 10/1977 Daly ..... A63B 53/08 473/338
4,180,269 A * 12/1979 Thompson ..... A63B 53/04 473/336
4,607,846 A * 8/1986 Perkins ..... A63B 53/047 473/336

(Continued)

FOREIGN PATENT DOCUMENTS

JP 09028844 A * 2/1997
JP 11155985 A * 6/1999

(Continued)

*Primary Examiner* — Alvin A Hunter
(74) *Attorney, Agent, or Firm* — Harper IP Law, PA; Wayne V. Harper

(57) ABSTRACT

Disclosed is a golf club and a self-contained balancing mechanism for existing golf club. The golf club includes a shaft having a proximal end portion and a distal end portion opposite to the proximal end portion; a grip attached to the proximal end portion of the shaft; a golf club head attached to the distal end portion of the shaft, the golf club head having a cavity formed therein; and a balancing mechanism adapted to be received within the cavity of the golf club head. The self-contained balancing mechanism comprises, a housing member, an elongated threaded member rotatably associated with the housing member, and a weighted member threadably engaged with the elongated threaded member. The rotation of the elongated threaded member moves the weighted member along the elongated threaded member to change a center of gravity of the golf club head.

19 Claims, 6 Drawing Sheets

(56) References Cited

U.S. PATENT DOCUMENTS 4,895,371 A * 1/1990 Bushner ..... A63B 60/02 473/336
4,962,932 A * 10/1990 Anderson ..... A63B 53/0487 473/336
5,013,041 A * 5/1991 Sun ..... A63B 53/04 473/252
5,571,053 A * 11/1996 Lane ..... A63B 53/065 473/336
5,688,189 A * 11/1997 Bland ..... A63B 53/065 473/314
6,015,354 A * 1/2000 Ahn ..... A63B 53/04 473/256
6,277,032 B1 * 8/2001 Smith ..... A63B 53/04 473/336
6,514,154 B1 * 2/2003 Finn ..... A63B 53/02 473/306
7,070,515 B1 * 7/2006 Liu ..... A63B 53/065 473/340
7,108,609 B2 * 9/2006 Stites ..... A63B 53/06 473/256
7,156,752 B1 * 1/2007 Bennett ..... A63B 53/02 473/334
7,351,161 B2 * 4/2008 Beach ..... A63B 53/0466 473/334
7,824,277 B2 * 11/2010 Bennett ..... A63B 53/0466 473/328
7,927,231 B2 * 4/2011 Sato ..... A63B 53/0466 473/334
9,149,693 B2 * 10/2015 Stites ..... A63B 53/0466
9,192,831 B2 * 11/2015 Stites ..... A63B 53/0466
9,259,627 B1 * 2/2016 Myers ..... A63B 53/04
9,421,432 B2 * 8/2016 Galvan ..... A63B 53/06
9,433,836 B2 * 9/2016 Breier ..... A63B 53/0466
9,597,563 B2 * 3/2017 Voshall ..... A63B 53/06
9,868,036 B1 * 1/2018 Kleinert ..... A63B 53/0466
9,987,528 B2 * 6/2018 Bennett ..... A63B 53/04
9,999,813 B2 * 6/2018 Cleghorn ..... A63B 53/0466
10,029,156 B2 * 7/2018 Yi ..... A63B 53/0466
10,213,665 B1 * 2/2019 Day ..... A63B 53/0466
10,357,699 B2 * 7/2019 Yi ..... A63B 53/0466
10,369,427 B2 * 8/2019 Sanchez ..... A63B 60/02

FOREIGN PATENT DOCUMENTS

JP 2000140169 A * 5/2000
JP 2000237360 A * 9/2000
JP 2006102235 A * 4/2006
JP 2006198385 A * 8/2006
JP 2007267777 A * 10/2007
JP 2011125623 A * 6/2011 ..... A63B 53/04
JP 2012135366 A * 7/2012

* cited by examiner

GOLF CLUB

FIELD OF THE INVENTION

The present invention generally relates to sports equipment, and, more particularly, to a golf club and a system for altering center of gravity of the golf club.

BACKGROUND OF THE INVENTION

Golf is a sport in which players use various types of clubs to hit balls into a series of holes provided on a course in as few strokes as possible. The clubs of golf, also referred to as "golf clubs," include various components such as a club head, a shaft, a grip, and various subcomponents thereof. The specifications for each of these components and subcomponents, directly impact the performance of the golf club. Therefore, by varying the design specifications of the components and subcomponents, a golf club can be tailored to have specific performance characteristics, as desired.

The design of the club heads has long been analyzed, with a view to improve its performance. Among the more prominent considerations in club head design are loft, lie, face angle, horizontal face bulge, vertical face roll, center of gravity (CG), inertia, material selection, and overall head weight. As such, center of gravity of a golf club head is one critical parameter of the club's performance. Upon impact, it greatly affects launch angle and flight trajectory of a golf ball.

Different golf clubs have different center of gravity (CG). While an expert golfers may be able to control the flight of the ball by controlling rotation of hands to impart a spin to the ball to an extent, a less skilled golfer tends to rely on attempting to hit the ball in such a manner that impact with the club head is made at the sweet spot which is generally located along a vertical line which runs directly opposite the center of gravity of the head. Further, various environmental and other conditions, such as presence or absence of rain on the course, extent of wind speed on the course etc. may make a certain position of center of gravity more suitable over other positions.

However, the golf clubs present hitherto tend to have a fixed center of gravity and therefore have been unable to provide options pertaining to changing of changing of the center of gravity of the golf club. Accordingly, the golfs clubs presently available fail to be suitable for both experts and beginners. In addition, the golfs clubs presently available fail to be suitable for different various environmental and course conditions.

Accordingly, there exists a need for a golf club that makes it easy and convenient for a golfer to use a golf club under various conditions and for various shorts, by providing an option of changing the center of gravity of the club head.

SUMMARY OF THE INVENTION

In view of the foregoing disadvantages inherent in the prior art, the general purpose of the present invention is to provide a golf club head to include all advantages of the prior art, and to overcome the drawbacks inherent in the prior art.

In one aspect of the present invention, a golf club is provided. The golf club includes a shaft having a proximal end portion and a distal end portion opposite to the proximal end portion; a grip attached to the proximal end portion of the shaft; a golf club head attached to the distal end portion of the shaft, the golf club head having a cavity formed therein; and a balancing mechanism adapted to be received within the cavity of the golf club head. The balancing mechanism is a self-contained unit that may be just accommodated snugly in the cavity of the golf club head to change a center of the gravity of the golf club head. Such self-contained balancing mechanism includes, a housing member, an elongated threaded member rotatably associated with the housing member, and a weighted member threadably engaged with the elongated threaded member. The rotation of the elongated threaded member moves the weighted member along the elongated threaded member to change the center of gravity of the golf club head.

In another aspect of the present invention, a self-contained, retrofittable balancing mechanism of a golf club is provided. The golf club includes a shaft, a grip attached to the shaft, and a golf club head attached to the shaft. The retrofittable balancing mechanism includes a housing member adapted to be to be coupled the golf club head; an elongated threaded member rotatably associated with the housing member; and a weighted member threadably engaged with the elongated threaded member. The rotation of the elongated threaded member moves the weighted member along the elongated threaded member to change the center of gravity of the golf club head. Such self-contained, retrofittable balancing mechanism may be retrofitted by attaching thereto to existing golf clubs of different shapes and sizes. The retrofittable balancing mechanism is a self-contained device that may be fitted, not just with existing golf clubs, but also with any other sport devices, such as badminton, tennis, bats, and so forth.

In another aspect of the present invention, a method for balancing a balancing mechanism of a golf club having a shaft, a grip attached to the shaft, and a golf club head attached to the shaft, is provided in accordance with an exemplary embodiment of the present disclosure. The method includes providing the balancing mechanism in a cavity of the golf club head. The balancing mechanism is a self-contained balancing mechanism that includes: a housing member adapted to be received within the cavity of the golf club head, an elongated threaded member rotatably associated with the housing member, and a weighted member threadably engaged with the elongated threaded member; and rotating the elongated threaded member to move the weighted member along the elongated threaded member to change center of gravity of the golf club head.

This together with the other aspects of the present invention, along with the various features of novelty that characterizes the present invention, is pointed out with particularity in the claims annexed hereto and forms a part of the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The terms, "a" and "an" herein do not denote a limitation of quantity, but rather denote the presence of at least one of the referenced items.

The present invention provides a golf club. The golf club includes a shaft having a proximal end portion and a distal end portion opposite to the proximal end portion; a grip attached to the proximal end portion of the shaft; a golf club head attached to the distal end portion of the shaft, the golf club head having a cavity formed therein; and a balancing mechanism adapted to be received within the cavity of the golf club head. The balancing mechanism comprises, a housing member, an elongated threaded member rotatably associated with the housing member, and a weighted member threadably engaged with the elongated threaded member. The rotation of the elongated threaded member moves the weighted member along the elongated threaded member to change a center of gravity of the golf club head.

The present invention also provides a retrofittable balancing mechanism of a golf club. The golf club includes a shaft, a grip attached to the shaft, and a golf club head attached to the shaft. The retrofittable balancing mechanism includes a housing member adapted to be coupled to the golf club head; an elongated threaded member rotatably associated with the housing member; and a weighted member threadably engaged with the elongated threaded member. The rotation of the elongated threaded member moves the weighted member along the elongated threaded member to change center of gravity of the golf club head.

Figure 1:
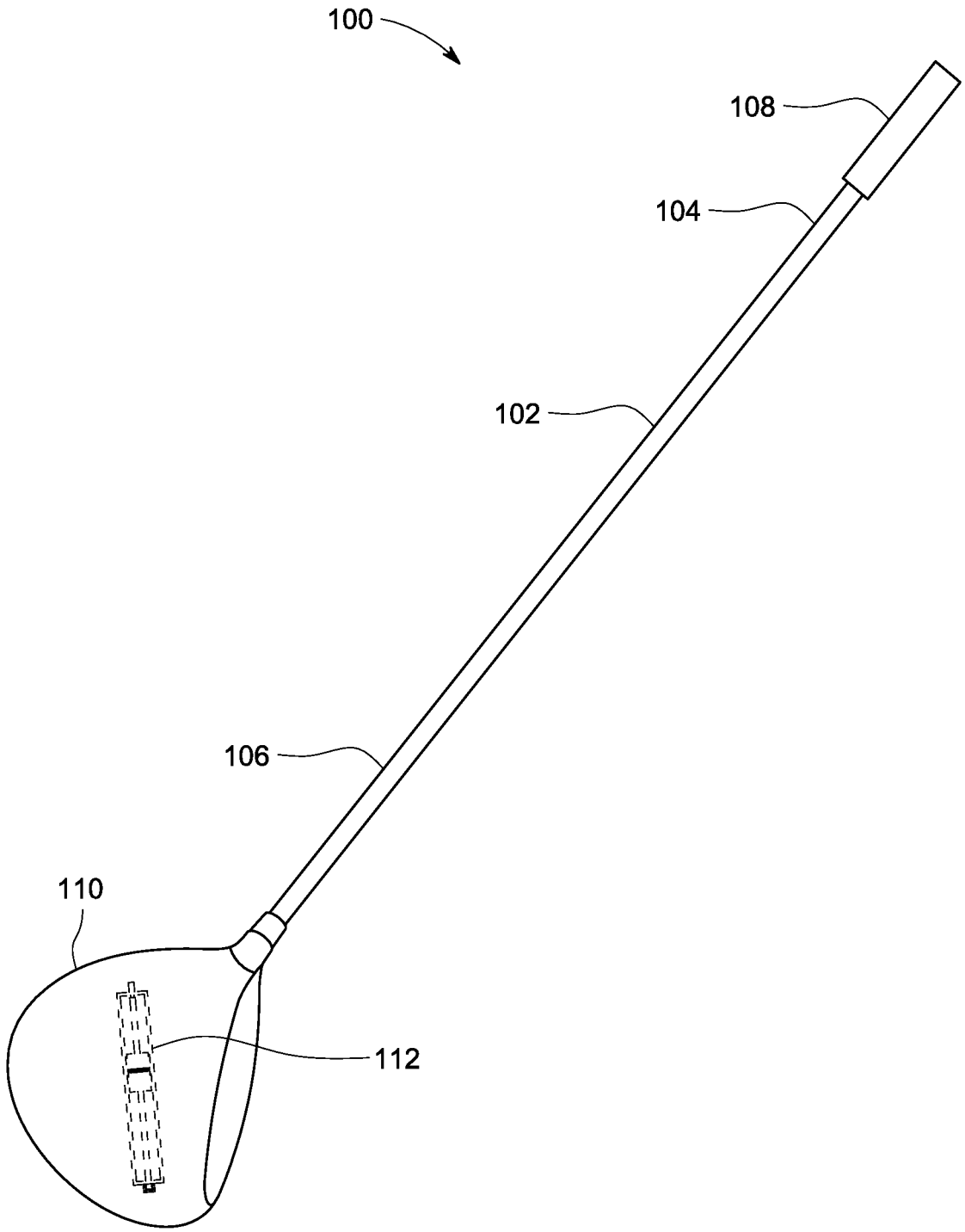
FIG. 1 illustrates a top view of a golf club, in accordance with an embodiment of the present invention.

Referring now to FIG. 1, a top view of a golf club 100 is illustrated, in accordance with an embodiment of the present invention. The golf club 100 includes a shaft 102 having a proximal end portion 104 and a distal end portion 106 opposite to the proximal end portion 104. The shaft 102 may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like.

The proximal end portion 104 of the shaft 102 is connected to a grip 108. In various examples, the grip or handle 108 may be attached to, engaged with, and/or extend from the shaft 102 in any suitable or desired manner, including in conventional manners known and used in the art, e.g., using adhesives or fasteners, etc. As another example, if desired, the grip or handle 108 may be integrally formed as a unitary, one-piece construction with the shaft 102. Additionally, any desired grip or handle materials may be used without departing from this disclosure, including, but not limited to, rubber materials, leather materials, other materials including cord or other fabric material embedded therein, polymeric materials, and the like.

The golf club 100 further includes a golf club head 110 attached to the shaft 102. In particular, the golf club head 110 is attached to the distal end portion 106 of the shaft 102. In various examples, the shaft 102 may be received in, engaged with, and/or attached to the golf club head 102 in any suitable or desired manner, including in conventional manners known and used in the art, without departing from the disclosure.

The golf club head 110 has a cavity 112 formed therein. Such cavity 112 may be prepared in the golf club head 110. In an embodiment, the cavity 112 has an elongated profile, and extends along an axis (not illustrated) of the golf club head 110. In other embodiments, the cavity 112 may have a cuboidal, oval or any other shaped profile, and may extend in any direction other than the length of the golf club head 110, without deviating from the spirit of the present disclosure.

Figure 2:
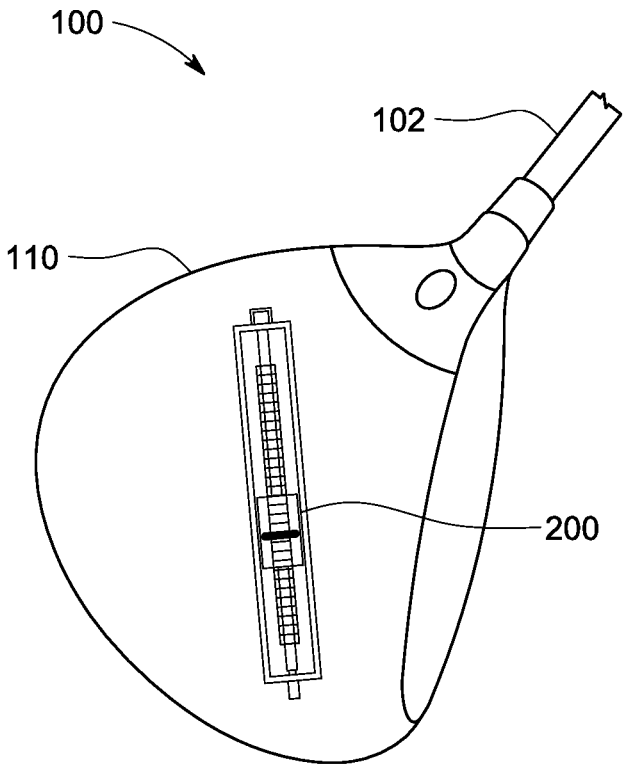
FIG. 2 illustrates an underside view of the golf club of FIG. 1, in accordance with an embodiment of the present invention.
Figure 3:
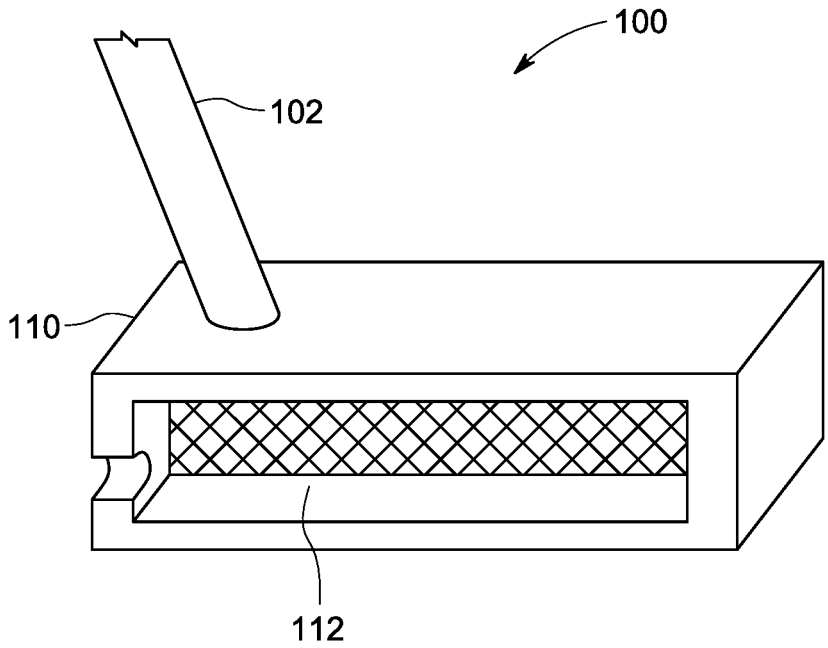
FIG. 3 illustrates a perspective view of a golf club, in accordance with an embodiment of the present invention showing a cavity designed to receive a balancing mechanism.
Figure 4:
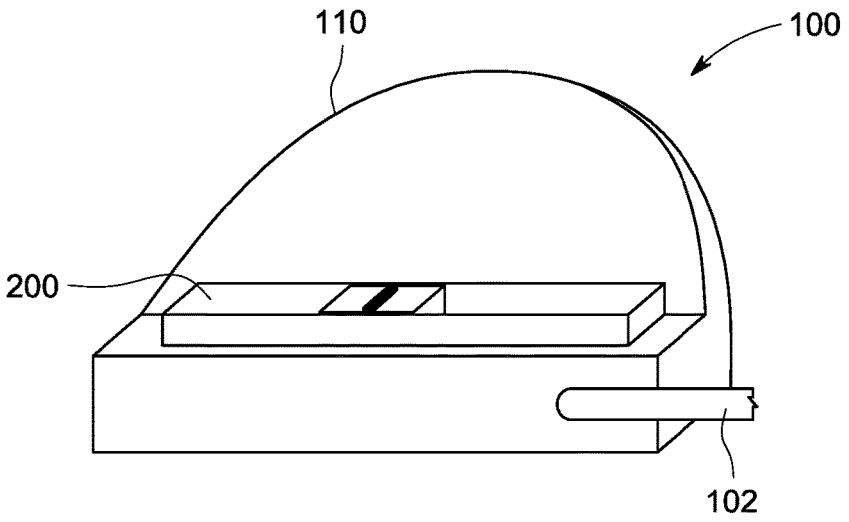
FIG. 4 illustrates a perspective view of the golf club, in accordance with an embodiment of the present invention with the complete self-contained, retrofittable mechanism attached to an existing golf club.

Referring now to FIG. 2, FIG. 3 and FIG. 4, the golf club 100 further includes a balancing mechanism 200. In one embodiment, the balancing mechanism 200 may be a retrofittable, self-contained device that can be fitted with any sport device, such as badminton, tennis, bats, and so forth. In example arrangement and in order to better understand the disclosure, the retrofittable balancing mechanism 200 as shown in various figures and explained herein in the specification is with golf club 200. Such explanation of the retrofittable balancing mechanism 200 in conjunction with the golf club 100 shall not be limiting in any manner. In one embodiment, the retrofittable balancing mechanism 200 (herein after may be referred to as 'balancing mechanism 200') may be connected to an existing golf club head, such as golf club head 110. In another embodiment, the balancing mechanism 200 may be removably connected to the cavity 112 of the golf club head 110. In another embodiment, the balancing mechanism 200 is adapted to be removably received within the cavity 112 of the golf club head 110. In alternative embodiments, the balancing mechanism 200 may be integral to the golf club head 110.

The balancing mechanism 200 has a length corresponding to length of the golf club head 110. Further, the length and of the balancing mechanism 200 may vary as per the design of the golf club head 110.

As illustrated in FIG. 3, the golf club 100 may be a putter. The golf club head 110 may have the cavity 112, embodied as a recess. The shaft 102 is also illustrated to be attached to the golf club head 110. As mentioned above, the balancing mechanism 200 may be received within the recess. In alternative embodiments, where the cavity 112 is absent from the golf club head 110, the balancing mechanism 200 may be attached onto an outer surface of the golf club head 110, as shown in FIG. 4.

Figure 5:
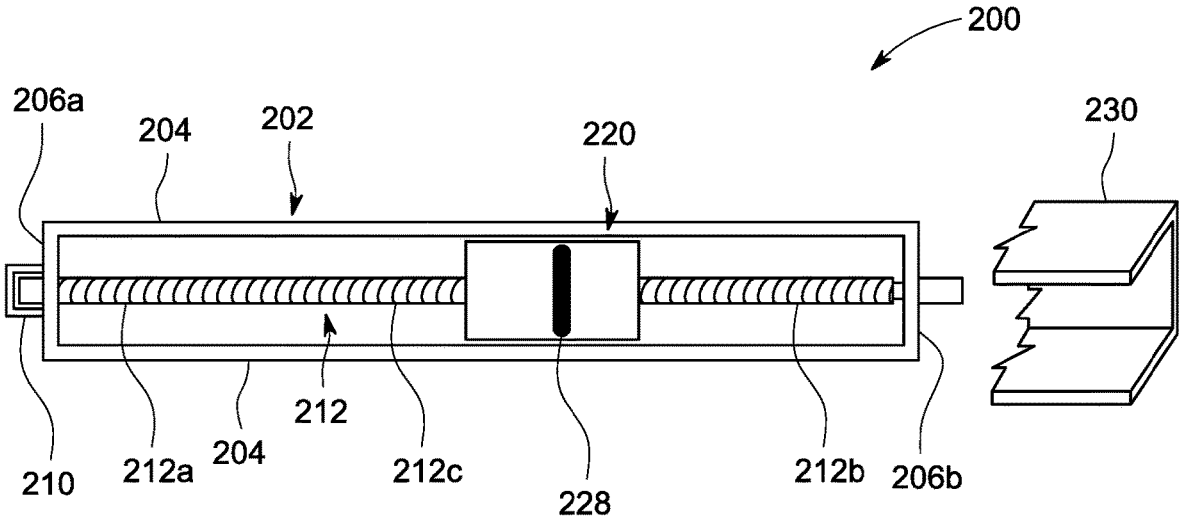
FIG. 5 illustrates a side view of a retrofittable balancing mechanism of the golf club of FIG. 1, in accordance with an embodiment of the present invention.
Figure 6:
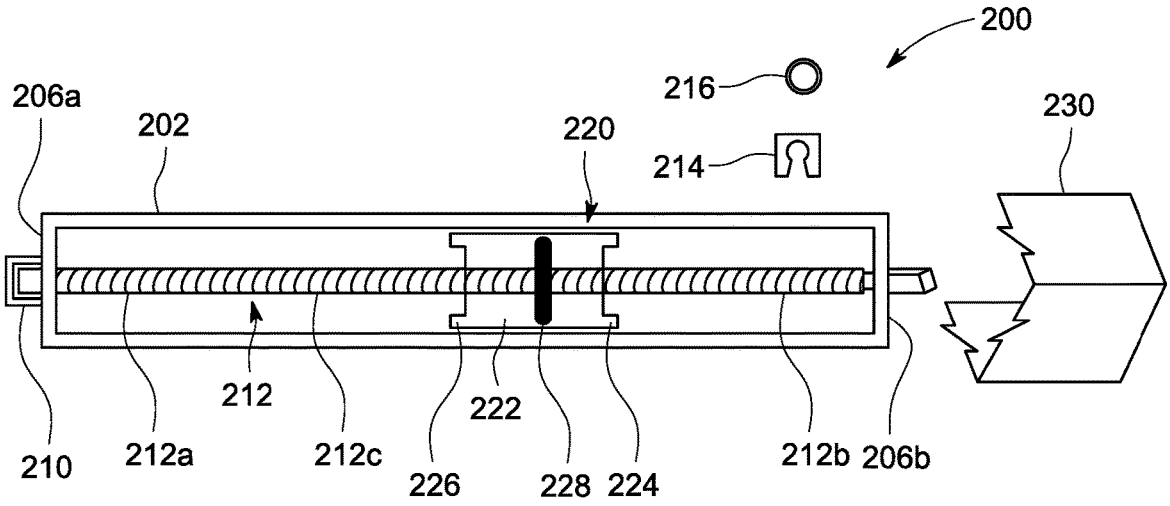
FIG. 6 illustrates a top view of the retrofittable balancing mechanism of the golf club of FIG. 1, without a cover to depict its internal parts, in accordance with an embodiment of the present invention.
Figure 7:
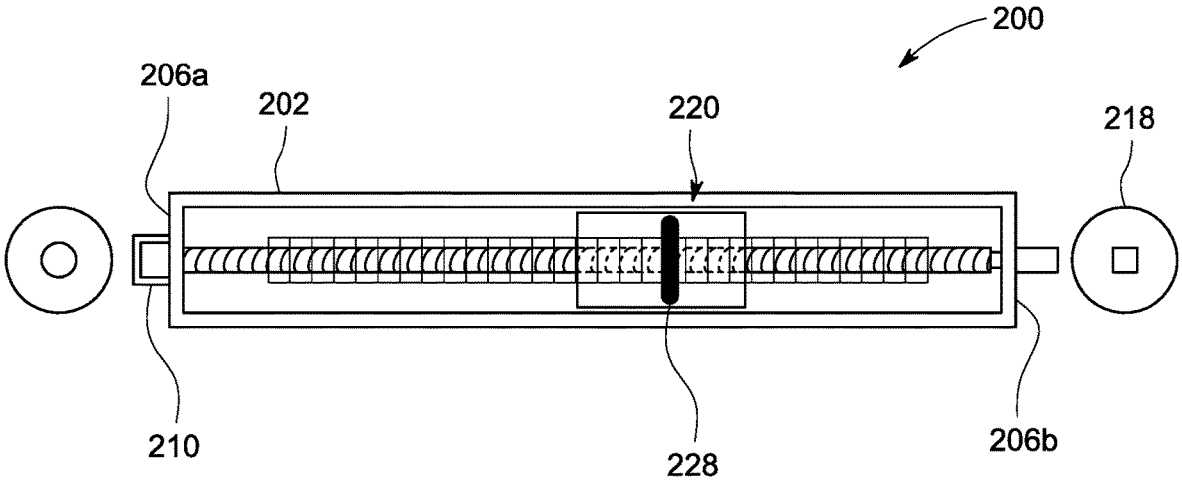
FIG. 7 illustrates a side view of the retrofittable balancing mechanism of the golf club of FIG. 1 showing the cover fitted and the indicator marking, with a key for adjustment on the end, in accordance with an embodiment of the present invention.

Referring now to FIG. 5, FIG. 6, and FIG. 7, various views of the balancing mechanism 200 are illustrated. The balancing mechanism 200 includes a housing member 202. In the disclosed example, the housing member 202 is shown to have an elongated cuboidal shape, however without departing from the scope of the present disclosure, the housing member 202 may include any other suitable shape. As such, the housing member 202 has a shape corresponding to the shape of the cavity 110. The housing member 202 is adapted to be received or snugly accommodated within the cavity 112 of the golf club head 110. The housing member 202 may also be secured to a surface of the golf club head using suitable attaching means such as Velcro, glues, screws and so forth.

The housing member 202 is one-piece structure. However, in order to have better understanding of overall structure to the person ordinary skilled in the art, the housing member 202 will be explained by the way of several parts, and it should not be misunderstood that these parts are not integral, as these parts are anyway integral part of the housing member 202 and formed as one-piece structure. As shown, the housing member 202 includes a plurality of longitudinal walls 204, an open side (not numbered), and two opposite end walls 206*a* and 206*b*. The plurality of longitudinal walls 204 extend along the length of the housing member 202 between the two opposite end walls 206*a* and 206*b*. As such, the longitudinal walls 204 connect to the end wall 206*a*, at a first end portion of the housing member 202, whereas the longitudinal walls 204 connect to the end wall 206*b* at a second end portion of the housing member 202. The end wall 206*b* provides the opening into which all the mechanism is inserted. This is then sealed and with the cover sealed makes the mechanism watertight. The end wall 206*a* includes an integral sealed projection 210 to hold the rotating end of the elongated threaded member 212. In one embodiment, the housing member 202 may be moulded one-piece outer casing structure into which the elongated threaded member and the weighted member and their mechanisms are inserted before being sealed using end piece 206*b* and/or a cover 230. This makes the housing member 202 a watertight enclosure to preclude entry of water, dirt etc. into the housing member 202. In one embodiment, the housing member 202 may be made of material that are transparent or translucent in nature with cover moulded as an integral part of the housing 202, showing the indicator portion in one piece.

The balancing mechanism 200 further includes an elongated threaded member 212. The elongated threaded member 212 is rotatably associated with the housing member 202. More specifically, the elongated threaded member 212 is rotatably associated with the opposite end walls 206*a* and 206*b* of the housing member 202.

The elongated threaded member 212 is one piece structure that is shown to include a first end portion 212*a* rotatably supported on the housing member 202, and a second end portion 212*b* opposite to the first end portion 212*a* and supported on the housing member 202, and a threaded body portion 212*c*. In an embodiment, the first end portion 212*a* is rotatably supported on the end wall 206*a* through the opening thereon, whereas the second end portion 212*b* is supported on the end wall 206*b* through the opening thereon. The connection of the first end portion 212*a* with the end wall 206*a* is such that the first end portion 212*a* is free to rotate about a longitudinal axis (not illustrated) thereof. The second end portion 212*b* is supported on the end wall 206*b* through a circlip 214 and an O Ring 216. The O Ring 216 precludes the entry of water, dirt etc. into the housing member 202 from the end wall 206*b*. On the other hand, the circlip 214 or another means is provided to preclude any undesired movement, i.e., a movement other than rotational movement, of the elongated threaded member 212. In any other embodiment, there may be any other sealing arrangement that may be included instead of O Ring 216 that may be provided to the housing member 202 to preclude the entry of water, dirt etc. into the housing member 202 from the end wall 206*b*.

The second end portion 212*b* of the elongated threaded member 212 has a predefined cross-sectional profile. In an embodiment, the predefined cross-sectional profile of the elongated threaded member 212 may be square shaped or other suitable shaped. The predefined cross-sectional profile of the second end portion 212*b* of the elongated threaded member 212 corresponds to the profile of a key 218. Therefore, the key 218 is adapted to be engage with the second end portion 212*b* of the elongated threaded member 212; and rotate the elongated threaded member 212 in one of a clockwise or anti-clockwise direction, or by using human fingers. The threaded body portion 212*c* extends between the first end portion 212*a*, and the second end portion 212*b* of the elongated threaded member 212. The threaded body portion 212*c* has an external threaded surface.

The self-contained balancing mechanism 200 further includes a weighted member 220. The weighed member 220 may be shaped like a cube or cuboid, having a central, internally threaded hole. In various embodiments, the weighted member 220 may be shaped like a ball, a round lozenge, square or a longer rectangular. In Further embodiments, a single ringed ridge may also be used in a round weighted member to act as a buffer at either end. The weighted member 220 has a predetermined weight. The predetermined weight of the weighted member 220 may be symmetrically divided about a center thereof. Alternatively, predetermined weight of the weighted member 220 may be non-symmetrically divided about the center thereof, without deviating from the spirit of the disclosure.

The weighted member 220 is engaged with the elongated threaded member 212. The weighted member 220 includes an internal threaded surface. The weighted member 220 is threadably engaged with the elongated threaded member 212. In an embodiment, the internal threaded surface of the weighted member 220 is threadably engaged with the external threaded surface of the threaded body portion 212*c* of the elongated threaded member 212.

Owing to such connection between the weighted member 220 and the threaded body portion 212*c* of the elongated threaded member 212, a clockwise or anti-clockwise rotation of the elongated threaded member 212 moves the weighted member 220 along the elongated threaded member 212 in one of a forward and a backward direction. The forward direction and the backward direction being direction along longitudinal axis of the elongated threaded member 212 towards the first end portion 212*a* or the second end portion 212*b* thereof. The dimensions of the weighted member 220 are such that the weighted member 220 is free to move within the housing member 202.

With the weighted member 220 at a position, say point A, on the elongated threaded member 212, the golf club head 110, has a corresponding center of gravity. When the elongated threaded member 212 is rotated, say in a clockwise direction, the weighted member 220 moves from the point A to point B and accordingly, the center of gravity of the golf club head 110 shifts. Further, when the elongated threaded member 212 is rotated, say in an anti-clockwise direction, the weighted member 220 moves from the point B to point A, and accordingly, the center of gravity of the golf club head 110 further shifts. With each different center of gravity, the golf club head 110 has different balance, and weigh distribution. The golf club 100 having the golf club head 110, with each of the different positions of the center of gravity tends to behave differently to suit different requirements of the golfer.

For example, if because of the conditions it is desired that the center or gravity or weight balance of golf club head 110 be changed, in order to obtain optimum results, the user of the golf club 100, may simply engage the key 218, with the second end portion 212*b* of the elongated threaded member 212, and rotate, or using human fingers to simply rotate the elongated threaded member 212 at the end 218*a*. The rotation of the elongated threaded member 212 will cause the weighted member 220 to move and accordingly, the center of gravity of the golf club head 110 will shift.

In FIG. 6, the plan view, the weighted member 220 includes a body portion 222, and one or more buffers, such as a first set of buffers 224 and a second set of buffers 226. The first set of buffers 224 extend laterally from the body portion 222 towards the first end portion of the housing member 202 whereas the second set of buffers 226 extend laterally from the body portion 222 towards the second end portion of the housing member 202. The first set of buffers 224, and the second set of buffers 226 resist contact of the body portion with respective end portions of the housing member 202 thereby precluding jamming or "locking up" of the weighted member 220 with respect to the housing member 202. In an embodiment, where the weighted member 220 may include a round, or a square or any other suitable shape, a circular rim at each end acts as a buffer.

Figure 8:
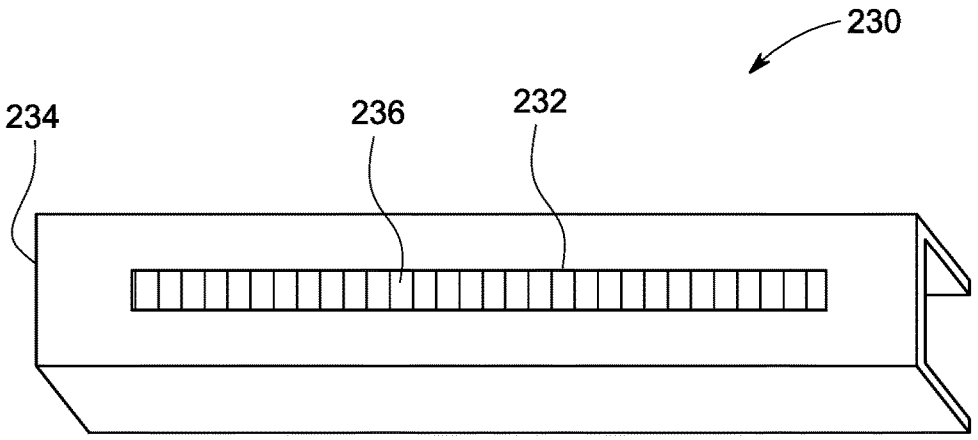
FIG. 8 illustrates a perspective view of a cover member of the retrofittable balancing mechanism of the golf club of FIG. 1, in accordance with an embodiment of the present invention.
Figure 9:
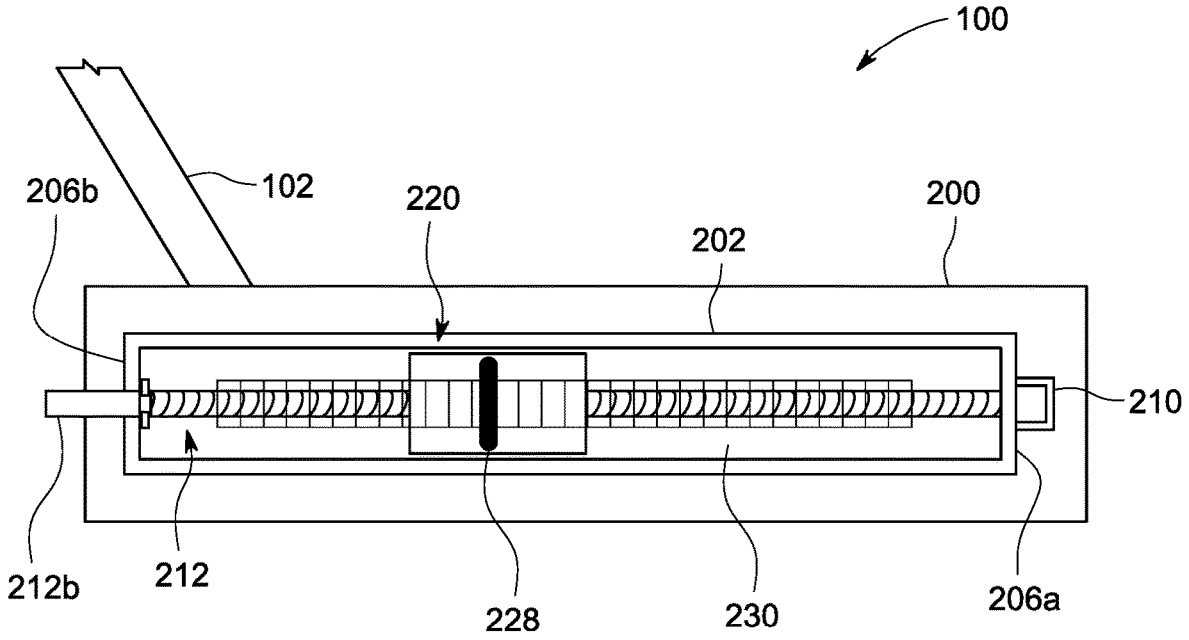
FIG. 9 illustrates a side view of the golf club of FIG. 1 with the cover fitted, in accordance with an embodiment of the present invention.

Referring now to FIG. 8 and FIG. 9, the balancing mechanism 200 further includes a cover member 230. The cover member 230 is sealed on the housing 202 to create a sealed unit connected to the housing member 202. The cover member 230 includes a plurality of side walls 234, and an indicator portion 232 provided on at least one of the plurality of walls 234. The indicator portion 232 may be composed of a translucent or transparent material. The indicator portion 232 may include vertical segmented markings 236. The segmented markings 236 may be scale printed or embossed or molded on the indicator portion 232 of the cover member 230. When the cover member 230 is connected to the housing member 202, the indicator portion 232 is positioned over the indicator 228. In an embodiment, the cover member 230 may be composed of a transparent or semi-transparent plastic type material.

Owing to the position of the indicator portion 232 of the cover member 230 over the housing member 202, the indicator 228 is visible to an observer, such as the golfer, through the indicator portion 232. The indicator portion 232 of the cover member 230 therefore allows the golfer to know about the position of the weighted member 220, over the elongated threaded member 212, and accordingly decide which direction the weighted member 220 is to be moved to obtain desired balance on the golf club 100.

Figure 10:
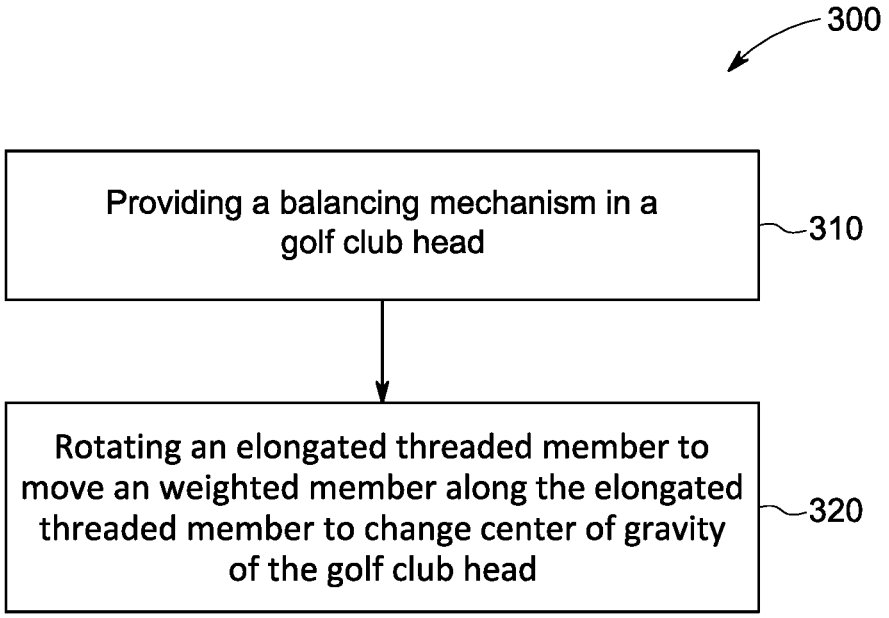
FIG. 10 illustrates a flow diagram indicating a method for balancing a balancing mechanism of a golf club.

Referring now to FIG. 10, a flow diagram indicating a method 300 for balancing a balancing mechanism of a golf club is illustrated. The golf club having a shaft, a grip attached to the shaft, and a golf club head attached to the shaft as described herein with reference to FIGS. 1-9, in accordance to an exemplary embodiment of the present disclosure. The method 300, at 310 provides the balancing mechanism as described herein with reference to FIGS. 1-9, in accordance to an exemplary embodiment of the present disclosure. At 320, an elongated threaded member, such as the elongated threaded member 212, is rotated to move a weighted member, such as the weighted member 220, along the elongated threaded member to change center of gravity of the golf club head. The rotation of the elongated threaded member moves the weighted member along the elongated threaded member in one of a forward and a backward direction.

In one embodiment, for rotation of the elongated threaded member includes engagement of a key, such as the key 218 with a second end portion, such as the second end portion 212*b*, opposite to a first end portion, such as the first end portion 212*a*, of the elongated threaded member, for rotating the elongated threaded member in one of a clockwise direction or an anti-clockwise direction. The rotation of the elongated threaded member in one of the clockwise direction or the anti-clockwise direction enables the weighted member to move and thereby shifting the center of gravity of the golf club head.

The present invention provides a golf club, such as the golf club 100, which offers the various advantages. The golf club 100 of the present invention is provided with a balancing mechanism, such as the balancing mechanism 200 that can be easily be operated using a key 218 to move the weighted member 220 in order to alter the weight balance or the center of gravity of the golf club head 110. The balancing mechanism 200 of the present disclosure can be fitted into various kinds of golf clubs, such as the woods or the putters. Further, the balancing mechanism 200 provides the users with an option to alter the weight balance or the center of gravity of the golf club head 110. In particular, the balancing mechanism 200 of the present disclosure, allows the golfers, either novice or professional, to adjust the golf club's Centre of Gravity depending on the conditions of the day, thereby correcting the path of the golf ball. The balancing mechanism 200, is also ideal as a teaching and improvement aid for the novice as well as the experienced golfer as it allows the golfers to accurately adjust the Centre of Gravity of the club to suit his playing conditions.

Moreover, the balancing mechanism 200 keeps adjustment of the center of gravity a precise, quick and easy and therefore can be conveniently done during practice or before playing a round of golf, without the need of employing any expensive tools. In addition, the balancing system 200 of the present disclosure, eliminates the need for trying different type of putters for balance as the variations using the elongated threaded member 212 and the weighted member 220 eliminates the need for different putters. Further, the position of the indicator portion 232 over the indicator 228 ensures that the indicator 228 is visible to the observer and accordingly the observer can judge current position of the weighted member 220 and decide which direction the weighted member 220 is to be moved to obtain desired balance on the golf club 100.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention.

What is claimed is:

1. A golf club comprising:

a shaft having a proximal end portion and a distal end portion opposite to the proximal end portion;

a grip attached to the proximal end portion of the shaft;

a golf club head attached to the distal end portion of the shaft, the golf club head having a cavity formed therein; and a self-contained balancing mechanism adapted to be received within the cavity of the golf club head, the balancing mechanism comprises, a housing member, an elongated threaded member rotatably associated with the housing member, and a weighted member threadably engaged with the elongated threaded member, wherein rotation of the elongated threaded member moves the weighted member along the elongated threaded member to change a center of gravity of the golf club head, wherein the weighted member comprises a body portion and one or more buffers, wherein the one or more buffers extend laterally towards first and second end portions of the housing member.

2. The golf club of claim 1, wherein the elongated threaded member is adapted to be rotated, whereby the rotation of the elongated threaded member moves the weighted member along the elongated threaded member in one of a forward and a backward direction.

3. The golf club of claim 1, wherein the weighted member further comprises an indicator provided on the body portion.

4. The golf club of claim 1, wherein each of the one or more buffers resist contact of the body portion with respective end portions of the housing member thereby preventing jamming of the weighted member with respect to the housing member.

5. The golf club of claim 1, wherein the housing member in the self-contained retrofittable balancing mechanism comprises:

a moulded, cast or manufactured one-piece structure to hold components of the self-contained retrofittable balancing mechanism, including an indicator portion and indicator of a movable weighted member, in a watertight manner, wherein the housing member is a transparent or semi-transparent showing the indicator portion on the housing member, and the indicator of the movable weighted member inside a weighted member.

6. The golf club of claim 1, wherein the elongated threaded member of the balancing mechanism comprises:

a first end portion rotatably supported on the housing member, and a second end portion opposite to the first end portion, wherein the second end portion is adapted to be engaged with a key for rotating the elongated threaded member.

7. The golf club of claim 1, wherein the balancing mechanism further comprises a cover member having an indicator portion, wherein the cover member is adapted to cover the housing member and the indicator portion is positioned proximate to the indicator provided on the body portion.

8. A self-contained retrofittable balancing mechanism of a golf club, the golf club having a shaft, a grip attached to the shaft, and a golf club head attached to the shaft, the self-contained retrofittable balancing mechanism comprising:

a housing member adapted to be coupled to the golf club head;

an elongated threaded member rotatably associated with the housing member; and a weighted member threadably engaged with the elongated threaded member, wherein rotation of the elongated threaded member moves the weighted member along the elongated threaded member to change center of gravity of the golf club head, wherein the weighted member comprises a body portion, one or more buffers, and an indicator provided on the body portion.

9. The self-contained retrofittable balancing mechanism of claim 8, wherein the elongated threaded member is adapted to be rotated, whereby the rotation of the elongated threaded member moves the weighted member along the elongated threaded member in one of a forward and a backward direction.

10. The self-contained retrofittable balancing mechanism of claim 8, wherein the one or more buffers extend laterally towards a first and second end portions of the housing.

11. The self-contained retrofittable balancing mechanism of claim 8, wherein each of the one or more buffers prevent contact of the body portion with respective end portions of the housing member.

12. The self-contained retrofittable balancing mechanism of claim 8, wherein the elongated threaded member of the balancing mechanism comprises:

a first end portion rotatably supported on the housing member, and a second end portion opposite to the first end portion, wherein the second end portion is adapted to be engaged with a key for rotating the elongated threaded member.

13. The self-contained retrofittable balancing mechanism of claim 8, wherein the self-contained retrofittable balancing mechanism is attachable to the golf clubs, wherein the self-contained retrofittable balancing mechanism is attachable the golf clubs via an attaching means including male-female joints, glues, screws and so forth.

14. The self-contained retrofittable balancing mechanism of claim 8, wherein the balancing mechanism further comprises a cover member having an indicator portion, wherein the cover member is adapted to cover the housing member and the indicator portion is positioned proximate to the indicator provided on the body portion.

15. A method for balancing a balancing mechanism attached to a golf club, the golf club having a shaft, a grip attached to the shaft, and a golf club head attached to the shaft, the method comprising:

providing the balancing mechanism with a cavity of the golf club head, the balancing mechanism being self-contained unit, and having:

a housing member adapted to be received within the cavity of the golf club head, an elongated threaded member rotatably associated with the housing member, and a weighted member threadably engaged with the elongated threaded member;

rotating the elongated threaded member to move the weighted member along the elongated threaded member to change center of gravity of the golf club head, wherein the weighted member comprises a body portion and one or more buffers wherein the one or more buffers extend laterally towards first and second end portions of the housing member, and resisting contact of the body portion with respective end portions of the housing member via each of the one or more buffers, thereby preventing jamming of the weighed member with respect to the housing member.

16. The method of claim 15, wherein the rotation of the elongated threaded member moves the weighted member along the elongated threaded member in one of a forward and a backward direction.

17. The method of claim 15, wherein rotating the elongated threaded member comprises:

engaging a key with a second end portion, opposite to a first end portion for the elongated threaded member, for rotating the elongated threaded member in one of a clockwise direction or an anti-clockwise direction.

18. The method of claim 17, wherein the rotation of the elongated threaded member in one of the clockwise direction or the anti-clockwise direction enables the weighted member to move and thereby shifting the center of gravity of the golf club head.

19. A golf club comprising:

a shaft having a proximal end portion and a distal end portion opposite to the proximal end portion, a grip attached to the proximal end portion of the shaft;

a golf club head attached to the distal end portion of the shaft, the golf club head having a cavity formed therein, wherein the cavity comprises an elongated profile, and extends along an axis of the golf club head; and a self-contained balancing mechanism adapted to be received within the cavity of the golf club head, the balancing mechanism comprises, a housing member, an elongated threaded member rotatably associated with the housing member, and a weighted member threadably engaged with the elongated threaded member, wherein rotation of the elongated threaded member moves the weighted member along the elongated threaded member to change a center of gravity of the golf club head, wherein the housing member comprises a shape corresponding to a shape of the cavity to be snugly accommodated within the elongated profile of the cavity that extends along the axis of the golf club head, thereby removably coupling the self-contained balancing mechanism with the golf club to change the center of gravity of the golf club head, wherein the weighted member comprises a body portion and one or more buffers wherein the one or more buffers extend laterally towards first and second end portions of the housing member.

* * * * *